US009046842B2

(12) United States Patent
Takagi

(10) Patent No.: US 9,046,842 B2
(45) Date of Patent: Jun. 2, 2015

(54) FIXING DEVICE AND IMAGE FORMING APPARATUS PROVIDED WITH SAME

(71) Applicant: KYOCERA Document Solutions Inc., Osaka-shi, Osaka (JP)

(72) Inventor: Masaru Takagi, Osaka (JP)

(73) Assignee: Kyocera Document Solutions Inc. (JP)

( * ) Notice: Subject to any disclaimer, the term of this patent is extended or adjusted under 35 U.S.C. 154(b) by 13 days.

(21) Appl. No.: 13/949,480

(22) Filed: Jul. 24, 2013

(65) Prior Publication Data

US 2014/0029993 A1 Jan. 30, 2014

(30) Foreign Application Priority Data

Jul. 26, 2012 (JP) ..... 2012-165627

(51) Int. Cl.
*G03G 15/20* (2006.01)

(52) U.S. Cl.
CPC .... *G03G 15/2089* (2013.01); *G03G 2215/2032* (2013.01); *G03G 15/2078* (2013.01); *G03G 2215/2016* (2013.01); *G03G 15/2053* (2013.01); *G03G 15/2057* (2013.01); *G03G 15/2064* (2013.01); *G03G 15/206* (2013.01)

(58) Field of Classification Search
CPC ..... G03G 15/20
USPC ..... 399/328
See application file for complete search history.

(56) References Cited

U.S. PATENT DOCUMENTS

| | | | | |
|---|---|---|---|---|
| 7,734,202 | B2 * | 6/2010 | Lee et al. | 399/45 |
| 8,010,017 | B2 * | 8/2011 | Foster et al. | 399/122 |
| 8,543,045 | B2 * | 9/2013 | Arikawa et al. | 399/328 |
| 2009/0185840 | A1 | 7/2009 | Inoue et al. | |
| 2009/0297196 | A1 * | 12/2009 | Yamanaka et al. | 399/67 |
| 2011/0170891 | A1 * | 7/2011 | Inoue | 399/67 |

FOREIGN PATENT DOCUMENTS

| | | | | |
|---|---|---|---|---|
| JP | 58-044476 | | 3/1983 | |
| JP | 05-100600 | * | 4/1993 | G03G 15/20 |
| JP | 2001-083833 | | 3/2001 | |

(Continued)

OTHER PUBLICATIONS

Summary of the Office Action Issued in Japanese Patent Application No. 2012-165627—Jul. 22, 2014.

*Primary Examiner* — Clayton E Laballe
*Assistant Examiner* — Kevin Butler
(74) *Attorney, Agent, or Firm* — Gerald E. Hespos; Michael J. Porco; Matthew T. Hespos

(57) ABSTRACT

A fixing device includes a heat source, a fixing roller, a pressure roller, an elastic layer, a pressing portion, a restricting portion and a driving unit. The fixing roller is heated by the heat source. The pressure roller is held in contact with the fixing roller and forms a fixing nip portion through which a sheet is to be passed. The elastic layer is formed on an inner layer of the fixing roller. The pressing portion presses one roller of the fixing roller and the pressure roller against the other roller while compressing the elastic layer. The restricting portion restricts a compression amount of the elastic layer lest the compression amount should exceed a preset compression amount when the pressing portion presses the roller. The driving unit drives and rotates one of the fixing roller and the pressure roller in a state where the compression amount is restricted.

13 Claims, 6 Drawing Sheets

(56) References Cited

FOREIGN PATENT DOCUMENTS

| | | | | | |
|---|---|---|---|---|---|
| JP | 2005-326702 | | 11/2005 | | |
| JP | 2006-018316 | | 1/2006 | | |
| JP | 2008-139690 | | 6/2008 | | |
| JP | 2008-165091 | * | 7/2008 | ..... | G03G 15/20 |
| JP | 2010-008573 | * | 1/2010 | ..... | G03G 15/20 |
| JP | 2010-139537 | | 6/2010 | | |

* cited by examiner

FIXING DEVICE AND IMAGE FORMING APPARATUS PROVIDED WITH SAME

This application is based on Japanese Patent Application Serial No. 2012-165627 filed with the Japan Patent Office on Jul. 26, 2012, the contents of which are hereby incorporated by reference.

BACKGROUND

The present disclosure relates to a fixing device for applying an image fixing process to a sheet and an image forming apparatus provided with the same.

Conventionally, in an image forming apparatus for forming an image on a sheet, a toner image is formed on a photoconductive drum and transferred to the sheet in a transfer unit. The image forming apparatus further includes a fixing unit and the sheet having the toner image transferred thereto is discharged after a fixing process is applied in the fixing unit.

In the fixing unit, the sheet is passed through a fixing nip portion formed between a fixing roller and a pressure roller, whereby the fixing process is applied to the sheet. Conventionally, a fixing unit is known which includes a fixing roller which is inserted into a fixing sleeve and whose diameter increases with an increase in the temperature of the fixing sleeve and a pressure roller which is held in contact with the outer circumferential surface of the fixing sleeve and sandwiches the fixing sleeve between the pressure roller and the fixing roller. The fixing sleeve is loosely fitted on the fixing roller at an ordinary temperature, whereas the fixing sleeve is closely fitted on the fixing roller when the fixing sleeve reaches a fixing temperature.

In the above technology, when the pressure roller is nipped by the fixing roller when the fixing roller is heated, an elastic layer of the fixing roller is largely compressed. Thus, a drive torque for rotating the fixing roller or the pressure roller becomes higher.

The present disclosure was developed in view of the above problem and aims to provide a fixing device capable of suppressing an increase in a drive torque for rotating a roller and an image forming apparatus provided with the same.

SUMMARY

A fixing device according to one aspect of the present disclosure includes a heat source, a fixing roller, a pressure roller, an elastic layer, a pressing portion, a restricting portion and a driving unit. The fixing roller is heated by the heat source. The pressure roller is held in contact with the fixing roller and forms a fixing nip portion, through which a sheet is to be passed, between the pressure roller and the fixing roller. The elastic layer is formed on a circumferential surface or an inner layer of the fixing roller or the pressure roller. The pressing portion presses one roller of the fixing roller and the pressure roller against the other roller while compressing the elastic layer. The restricting portion restricts a compression amount of the elastic layer lest the compression amount should exceed a preset compression amount when the pressing portion presses the roller. The driving unit drives and rotates one of the fixing roller and the pressure roller in a state where the compression amount is restricted by the restricting portion.

An image forming apparatus according to another aspect of the present disclosure includes an image forming unit and the above fixing device. The image forming unit forms an image on a sheet.

These and other objects, features and advantages of the present disclosure will become more apparent upon reading the following detailed description along with the accompanying drawings.

DETAILED DESCRIPTION

Figure 1:
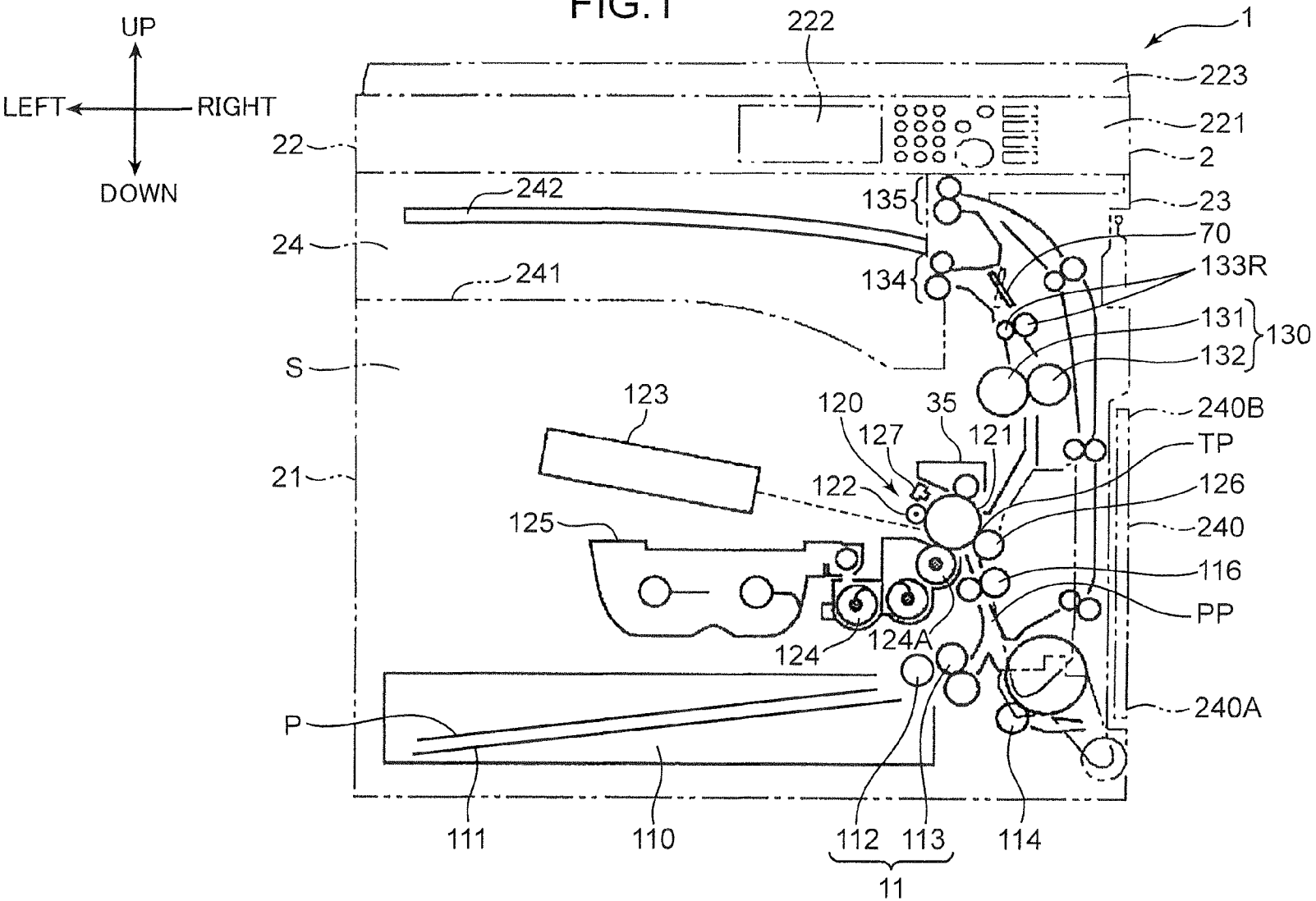
FIG. 1 is an internal sectional view of an image forming apparatus according to an embodiment of the present disclosure.
Figure 2:
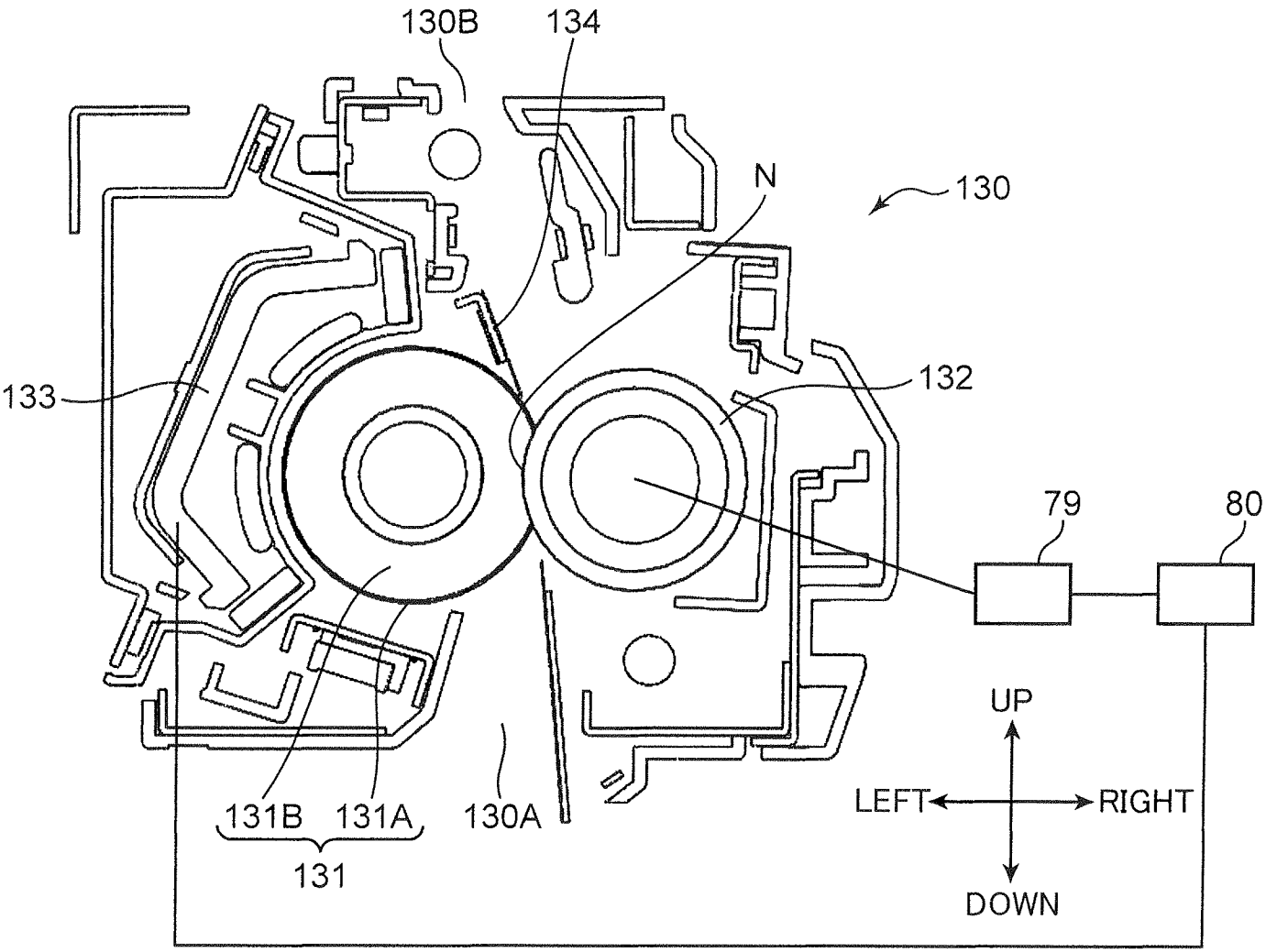
FIG. 2 is a sectional view of a fixing device according to the embodiment of the present disclosure.

Hereinafter, one embodiment of the present disclosure is described with reference to the drawings. FIG. 1 is an internal sectional view of an image forming apparatus 1 according to one embodiment of the present disclosure. FIG. 2 is an internal sectional view of a fixing device 130 of the image forming apparatus 1. Although the image forming apparatus 1 shown in FIG. 1 is a so-called black-and-white complex machine, it may be another apparatus for forming a toner image on a sheet such as a color complex machine, a color printer or a facsimile machine in another embodiment. Note that direction-indicating terms such as "upper" and "lower", "front" and "back", "left" and "right" used in the following description are merely for the purpose of clarifying the description and do not limit the principle of the image forming apparatus at all. Further, in the following description, a term "sheet" means a copy sheet, a coated paper, an OHP sheet, a cardboard, a postcard, a tracing paper or another sheet material to which an image forming process is to be applied or another sheet material to which an arbitrary process other than the image forming process is to be applied.

The image forming apparatus 1 includes a substantially rectangular parallelepipedic main housing 2. The main housing 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. The coupling housing 23 extends along the right edge and the back edge of the main housing 2. A sheet having a printing process applied thereto is discharged to a discharge space 24 enclosed by the lower housing 21, the upper housing 22 and the coupling housing 23. Particularly, in this embodiment, a sheet is discharged to a sheet discharging portion 241 arranged on the upper surface of the lower housing 21 or to a discharge tray 242 arranged above the sheet discharging portion 241.

An operation unit 221 arranged on the front surface of the upper housing 22 includes, for example, an LCD touch panel 222. The operation unit 221 is so formed that information on an image forming process can be input. A user can input the number of sheets to be printed, print density and the like, for example, through the LCD touch panel 222. A device for reading an image of a document and an electronic circuit for administrating an overall control of the image forming apparatus 1 are mainly housed in the upper housing 22.

A pressing cover 223 arranged atop the upper housing 22 is used to press a document. The pressing cover 223 is mounted on the upper housing 22 rotatably upward and downward. The user rotates the pressing cover 223 upward and places a document on the upper housing 22. Thereafter, the user can cause the device arranged in the upper housing 22 to read an image of the document by operating the operation unit 221.

A manual feed tray 240 is arranged on the right surface of the lower housing 21. An upper end 240B of the manual feed tray 240 is vertically rotatable about a lower end 240A. When the manual feed tray 240 is rotated downward and located at a position to project rightward of the lower housing 21, the user can place a sheet on the manual feed tray 240. The sheet on the manual feed tray 240 is pulled into the lower housing 21, has an image forming process applied thereto and is discharged to the discharge space 24 based on an instruction entered by the user through the operation unit 221. Further, an inner space S in which various devices to be described later are arranged is formed in the lower housing 21.

The image forming apparatus 1 includes a cassette 110, a sheet feeding unit 11, a second feed roller 114, a pair of registration rollers 116 and an image forming unit 120 in the inner space S. The sheet feeding unit 11 includes a pickup roller 112 and a first feed roller 113. The sheet feeding unit 11 feeds a sheet P to a sheet conveyance path PP. The sheet conveyance path PP is a conveyance path arranged to extend from the sheet feeding unit 11 through a transfer position TP arranged in the image forming unit 120 via the pair of registration rollers 116.

The cassette 110 stores sheets P inside. The cassette 110 can be pulled out in a forward direction (direction forward of the plane of FIG. 1) from the lower housing 21. The sheet P stored in the cassette 110 is fed upward in the lower housing 21. Thereafter, the sheet P has an image forming process applied in the lower housing 21 and discharged to the discharge space 24 based on an instruction entered by the user through the operation unit 221. The cassette 110 includes a lift plate 111 for supporting the sheets P. The lift plate 111 is inclined to push up the leading edges of the sheets P.

The pickup roller 112 is arranged above the leading edges of the sheets P pushed up by the lift plate 111. When the pickup roller 112 rotates, the sheet P is pulled out from the cassette 110.

The first feed roller 113 is arranged downstream of the pickup roller 112 in a sheet conveying direction. The first feed roller 113 feeds the sheet P to a further downstream side in the sheet conveying direction. The second feed roller 114 is arranged at the inner side of the lower end 240A of the manual feed tray 240. The second feed roller 114 conveys a sheet P on the manual feed tray 240 into the lower housing 21. The user can selectively use the sheet P stored in the cassette 110 or the sheet P placed on the manual feed tray 240.

The pair of registration rollers 116 specify the position of the sheet P in a direction perpendicular to the sheet conveying direction. In this way, the position of an image to be formed on the sheet P is adjusted. A nip portion is formed between the pair of registration rollers 116. The pair of registration rollers 116 convey the sheet P to the image forming unit 120 in synchronization with a timing at which a toner image is transferred to the sheet P in the image forming unit 120. Further, the pair of registration rollers 116 have a function of correcting the oblique feed (screw) of the sheet P.

The image forming unit 120 includes a photoconductive drum 121, a charger 122, an exposure device 123, a developing device 124, a toner container 125, a transfer roller 126, a cleaning device 35 and a charge remover 127.

The photoconductive drum 121 has a cylindrical shape. On the circumferential surface of the photoconductive drum 121, an electrostatic latent image is formed and a toner image corresponding to the electrostatic latent image is carried.

A predetermined voltage is applied to the charger 122, which substantially uniformly charges the circumferential surface of the photoconductive drum 121. The exposure device 123 irradiates the circumferential surface of the photoconductive drum 121 charged by the charger 122 with laser light. This laser light is irradiated in accordance with image data output from an external apparatus (not shown) such as a personal computer communicably connected to the image forming apparatus 1. As a result, an electrostatic latent image corresponding to the image data is formed on the circumferential surface of the photoconductive drum 121.

The developing device 124 supplies toner to the circumferential surface of the photoconductive drum 121 on which an electrostatic latent image is formed. The toner container 125 supplies the toner to the developing device 124 successively or according to need. When the developing device 124 supplies the toner to the photoconductive drum 121, the electrostatic latent image formed on the circumferential surface of the photoconductive drum 121 is developed (visualized). As a result, a toner image is formed on the circumferential surface of the photoconductive drum 121. The developing device 124 includes a developing roller 124A for carrying the toner on the circumferential surface. The developing roller 124A is arranged to face the photoconductive drum 121 at a developing position. The developing roller 124A is driven and rotated to supply the toner to the photoconductive drum 121.

The transfer roller 126 is arranged to face the circumferential surface of the photoconductive drum 121 at the transfer position TP. The transfer roller 126 is driven and rotated in the same direction as the photoconductive drum 121 at the transfer position TP. At the transfer position TP, the toner image formed on the circumferential surface of the photoconductive drum 121 is transferred to the sheet P.

The cleaning device 35 removes the toner remaining on the circumferential surface of the photoconductive drum 121 after the toner image is transferred to the sheet P. The charge remover 127 irradiates predetermined charge removing light to the photoconductive drum 121 whose circumferential surface is cleaned by the cleaning device 35. As a result, a potential on the circumferential surface of the photoconductive drum 121 is made uniform.

The circumferential surface of the photoconductive drum 121 having charges removed by the charge remover 127 after being cleaned by the cleaning device 35 passes below the charger 122 again to be uniformly charged. Thereafter, a new toner image is formed in a manner as described above.

The image forming apparatus 1 further includes the fixing device 130, which fixes a toner image on a sheet P, at a side downstream of the image forming unit 120 in the conveying direction. With reference to FIG. 2, the fixing device 130 includes a fixing roller 131 for melting the toner on the sheet P, a pressure roller 132 for pressing the sheet P into close contact with the fixing roller 131 and an IH unit 133 (heat source) for heating the fixing roller 131. Further, the fixing roller 131 includes a fixing belt 131A on the circumferential surface. The fixing belt 131A is externally fitted on the outer surface of the fixing roller 131. The fixing roller 131 is heated by the IH unit 133. Further, an elastic layer 131B made of a silicon-based sponge material is arranged inside the fixing roller 131. Further, the pressure roller 132 is made of silicon-based rubber (solid rubber). The pressure roller 132 is held in contact with the fixing roller 131 and a fixing nip portion N through which a sheet is to be passed is formed between the pressure roller 132 and the fixing roller 131. Specifically, when the pressure roller 132 is pressed against the fixing roller 131 by a pressing portion 700 to be described later, the elastic layer 131B of the fixing roller 131 is compressed and deformed, whereby the fixing nip portion N having a predetermined width in a circumferential direction is formed. When the sheet P passes through the fixing nip portion N between the fixing roller 131 and the pressure roller 132, the toner image is fixed to the sheet P. The IH unit 133 is arranged to face the circumferential surface of the fixing roller 131 at a side opposite to the fixing nip portion N and heats the fixing roller 131 (fixing belt 131A). Note that the sheet P is carried in through a carry-in opening 130A formed in a lower part of the fixing device 130 and discharged through a discharge opening 130B formed in an upper part of the fixing device 130. The fixing device 130 further includes a separating member 134 and a drive motor 79 (driving unit). The separating member 134 is held in contact with the circumferential surface of the fixing roller 131 to separate the sheet P at a side downstream of the fixing nip portion N. The drive motor 79 is a motor for driving and rotating the fixing roller 131. Note that the fixing roller 131 is rotated by the rotation of the pressure roller 132. The rotation of the drive motor 79 is controlled by a control unit 80 to be described later. The drive motor 79 drives and rotates the pressure roller 132 in a state where a compression amount of the elastic layer 131B of the fixing roller 131 is restricted by a restricting portion 5 to be described later.

With reference to FIG. 1, the image forming apparatus 1 further includes a pair of conveyor rollers 133R arranged downstream of the fixing device 130, a switching portion 70 arranged downstream of the pair of conveyor rollers 133R, a lower discharge roller 134 and an upper discharge roller 135. The pair of conveyor rollers 133R convey the sheet P, to which the fixing process was applied by the fixing device 130, to a downstream side in the sheet conveying direction. The switching portion 70 has a function of switching the conveying direction of the sheet P at a side downstream of the pair of conveyor rollers 133R in the sheet conveying direction. The lower discharge roller 134 is arranged to the left of the switching portion 70 and discharges the sheet P conveyed by the pair of conveyor rollers 133R to the sheet discharging portion 241. The upper discharge roller 135 is arranged above the lower discharge roller 134 and discharges the sheet P conveyed by the pair of conveyor rollers 133R to the discharge tray 242 mounted above the sheet discharging portion 241.

Figure 3:
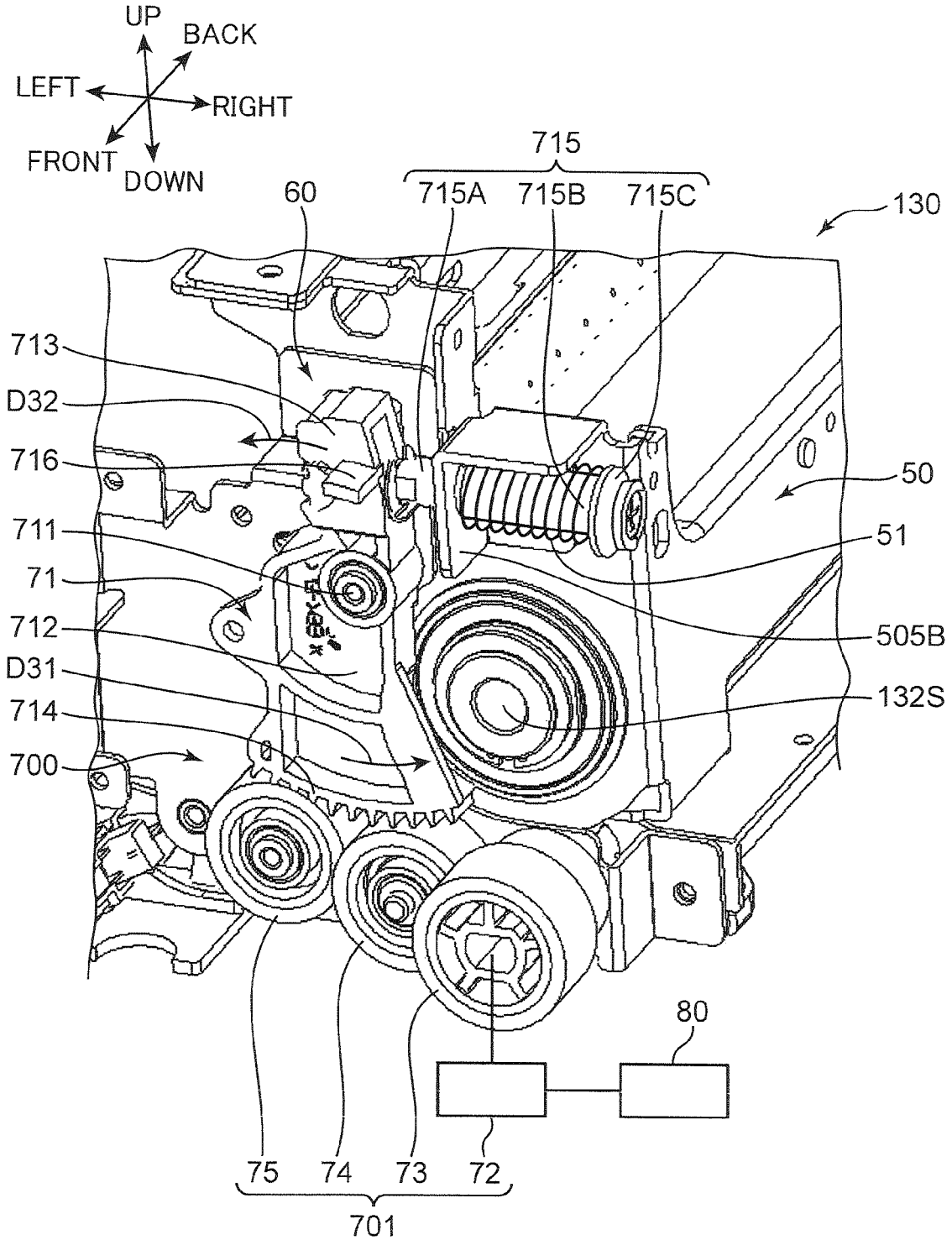
FIG. 3 is an enlarged perspective view of one end side of the fixing device according to the embodiment of the present disclosure.
Figure 4:
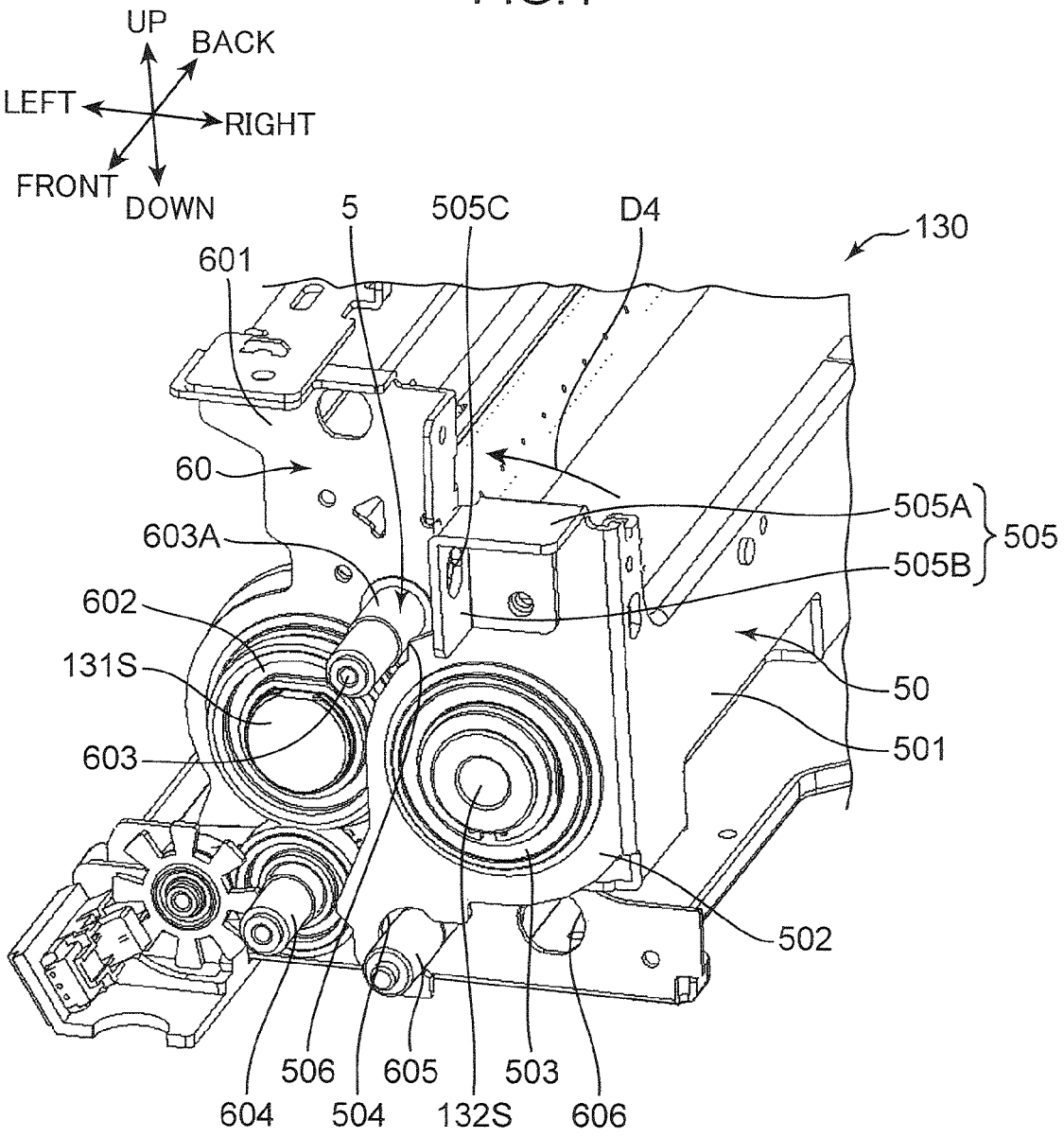
FIG. 4 is a perspective view showing the interior of the fixing device according to the embodiment of the present disclosure.

Next, the internal structure of the fixing device 130 is described in more detail with reference to FIGS. 3 and 4. FIG. 3 is a perspective view enlargedly showing a front end part of the fixing device 130. FIG. 4 is a perspective view showing the front end part of FIG. 3 excluding a drive transmission piece 71 to be described later.

The fixing device 130 includes a fixing housing 60 (first housing) and a pressing housing 50 (second housing).

The fixing housing 60 (FIG. 4) rotatably supports the fixing roller 131. The fixing housing 60 includes housing-side wall portions 601 (first side wall portions), a fixing roller bearing portion 602 (first bearing portion), a first shaft portion 603 (second rotary shaft), a second shaft portion 604, a third shaft portion 605 (first rotary shaft) and a drive shaft hole 606.

Figure 5:
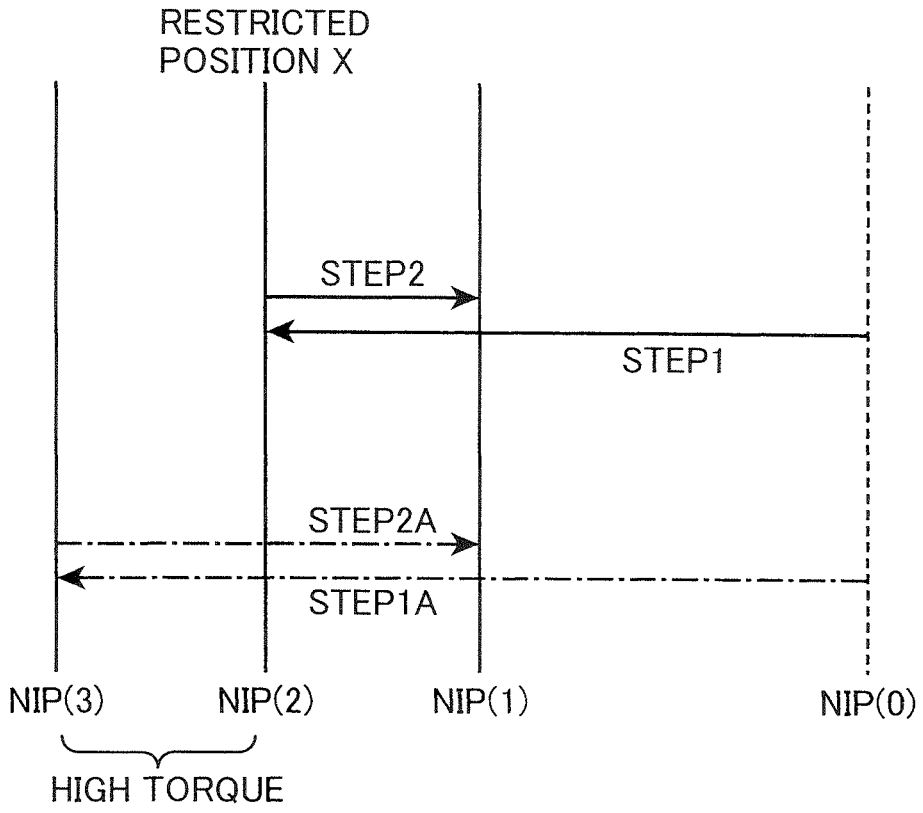
FIG. 5 is a chart showing a nip state between rollers of the fixing device according to the embodiment of the present disclosure.

The housing-side wall portions 601 are a pair of side walls of the fixing housing 60 arranged to face each other in forward and backward directions. Note that only the front housing-side wall portion 601 is shown in FIGS. 4 and 5.

The fixing roller bearing portion 602 is a bearing portion fitted substantially in a vertical central parts of the housing-side wall portion 601. The fixing roller bearing portion 602 rotatably supports a fixing roller shaft 131S which is a rotary shaft of the fixing roller 131.

The first shaft portion 603 is a cylindrical shaft portion projecting in an axial direction of the fixing roller shaft 131S immediately to the right of and above the fixing roller bearing portion 602. An outer diameter of a base end part of the first shaft portion 603 near the housing-side wall portion 601 is set to be slightly larger than that of a leading end part. A contact surface 603A (contacted portion) is formed on the circumferential surface of the base end part. A restricting contact portion 506 to be described later is brought into contact with the contact surface 603A. On the other hand, the drive transmission piece 71 to be described later is rotatably fitted on the leading end part of the first shaft portion 603.

The second shaft portion 604 is a cylindrical shaft portion projecting in the axial direction from the housing-side wall portion 601 below the fixing roller bearing portion 602. A drive transmission gear 75 to be described later is rotatably mounted on the second shaft portion 604.

The third shaft portion 605 is a cylindrical shaft portion projecting in the axial direction from the housing-side wall portion 601 at the right side of the second shaft portion 604. An engaging hole 504 of the pressing housing 50 to be described later is rotatably engaged with a base end part of the third shaft portion 605. Further, an idler gear 74 to be described later is rotatably mounted on a leading end part of the third shaft portion 605.

The drive shaft hole 606 is a hole portion which is open on the housing-side wall portion 601 at the right side of the third shaft portion 605. An unillustrated rotary shaft is fixed to the drive shaft hole 606. A drive gear 73 to be described later is rotatably mounted on this rotary shaft.

The pressing housing 50 rotatably supports the pressure roller 132. The pressing housing 50 includes a connecting portion 501, pressing-side wall portions 502 (second side wall portions), a pressure roller bearing portion 503 (second bearing portion), an engaging hole 504 (engaging portion), a biasing portion 505 and a restricting contact portion 506 (contact portion).

The connecting portion 501 is a plate-like member extending an axial direction of the pressure roller 132 on the right side of the pressure roller 132. The connecting portion 501 connects a pair of pressing-side wall portions 502.

The pressing-side wall portions 502 are a pair of side wall portions connected to opposite front and rear end parts of the connecting portion 501. Note that only the front pressing-side wall portion 502 is shown in FIGS. 4 and 5. A lower end part of the pressing-side wall portion 502 is shaped to project to a left lower side.

The pressure roller bearing portion 503 is a bearing portion fitted in a substantially vertical central part of the pressing-side wall portion 502. The pressure roller bearing portion 503 rotatably supports a pressure roller shaft 132S which is a rotary shaft of the pressure roller 132.

The engaging hole 504 is a hole portion which is open on a downward projecting part of the pressing-side wall portion 502. The base end part of the third shaft portion 605 of the fixing housing 60 is inserted into the engaging hole 504. As a result, the pressing-housing 50 is rotatable about the third shaft portion 605 of the fixing housing 60.

The biasing portion 505 is arranged on an upper left end part of the pressing-side wall portion 502. Further, the biasing portion 505 is arranged at a side of the pressure roller bearing portion 503 opposite to the engaging hole 504. The biasing portion 505 includes an upper wall 505A and a biasing wall 505B. The upper wall 505A is a wall portion extending forward from the upper end edge of the pressing-side wall portion 502. Further, the biasing wall 505B is a wall portion extending forward from an upper end part of the left end edge of the pressing-side wall portion 502. The biasing wall 505B is arranged to intersect with the upper wall 505A. Further, a hole portion 505C (opening) is arranged in the biasing wall 505B. The hole portion 505C is a hole portion formed to face the fixing housing 60.

The restricting contact portion 506 is a projecting piece formed by a part of the left end edge of the pressing-side wall portion 502 projecting leftwardly between the biasing portion 505 and the pressure roller bearing portion 503 in a vertical direction. According to the rotation of the pressing housing 50, the restricting contact portion 506 can come into contact with the contact surface 603A of the fixing housing 60. In other words, the restricting portion 5 (FIG. 4) for restricting an inter-axis distance between the pressure roller 132 and the fixing roller 131 is formed by the restricting contact portion 506 and the contact surface 603A. The restricting portion 5 restricts a compression amount of the elastic layer 131B of the fixing roller 131 lest the compression amount should exceed a preset compression amount when the pressing portion 700 to be described later presses the pressure roller 132. At this time, the restricting portion 5 restricts the compression amount of the elastic layer 131B by restricting the inter-axis distance between the fixing roller 131 and the pressure roller 132 lest the inter-axis distance should become equal to or shorter than a preset distance.

Further, the fixing device 130 includes the pressing portion 700 (FIG. 3). The pressing portion 700 has a function of pressing the pressure roller 132 against the fixing roller 131 while compressing the elastic layer 131B of the fixing roller 131. Particularly in this embodiment, the pressing portion 700 presses the pressure roller 132 against the fixing roller 131 by biasing the pressing housing 50 toward the fixing housing 60.

The pressing portion 700 includes the drive transmission piece 71 (rotation piece), a biasing spring 51 and a pressing/driving unit 701.

The drive transmission piece 71 is rotatably coupled to the first shaft portion 603 (FIG. 4). The drive transmission piece 71 has a substantially isosceles triangular shape with an apex on an upper side, and a bottom side part thereof has an arcuate shape. The drive transmission piece 71 includes a supporting point portion 711, a drive input piece 712 (second rotating portion), a traction piece 713 (first rotating portion), a gear portion 714, a load shaft 715 (shaft portion) and a detection piece 716.

The supporting point portion 711 is arranged substantially in a vertical central part of the drive transmission piece 71. The supporting point portion 711 is composed of a through hole penetrating in forward and backward directions and rotatably supported on the first shaft portion 603 described above.

The drive input piece 712 is a part of the drive transmission piece 71 extending downwardly from the supporting point portion 711. Further, the traction piece 713 is a part of the drive transmission piece 71 extending upwardly from the supporting point portion 711. The gear portion 714 is a gear part arranged to have an arcuate shape on the lower end of the drive input piece 712.

Further, the load shaft 715 is a cylindrical member extending rightwardly from an upper end part of the traction piece 713. The load shaft 715 extends through the hole portion 505C (FIG. 4) of the pressing housing 50. The load shaft 715 includes a base end portion 715A, a main portion 715B and a flange portion 715C. The base end portion 715A is coupled to the traction piece 713 at the left side of the biasing wall 505B. The main portion 715B is connected to the base end portion 715A and extends rightward of the biasing wall 505B. The flange portion 715C is a flange part arranged on a right end part of the biasing wall 505B. When the traction piece 713 is rotated about the supporting point portion 711 (first shaft portion 603), the load shaft 715 is laterally slidable. In other words, the load shaft 715 is relatively slidable with respect to the biasing wall 505B.

The detection piece 716 is a projecting piece projecting forwardly from the traction piece 713. When the traction piece 713 is rotated about the supporting point portion 711, the detection piece 716 is laterally moved. At this time, the detection piece 716 is detected by an unillustrated sensor fixed to the fixing housing 60, whereby the rotation of the drive transmission piece 71 is stopped. Specifically, if a nip pressure in the fixing nip portion N reaches a preset value in pressing the pressure roller 132 against the fixing roller 131, the above sensor detects the detection piece 716 and the pressing of the pressure roller 132 is stopped.

The biasing spring 51 is externally fitted on the load shaft 715 and compressibly arranged between the jaw portion 715C of the load shaft 715 and the biasing wall 505B. When the load shaft 715 is slid leftwardly, the biasing spring 51 is compressed and deformed to bias the biasing wall 505B leftwardly. A pressing force exerted to the fixing roller 131 by the pressure roller 132 is adjusted by the biasing spring 51. When a fixing process is applied to a sheet P in the fixing device 130, a steady load state is maintained by the biasing spring 51 in the fixing nip portion N of the fixing roller 131 and the pressure roller 132.

The pressing/driving unit 701 includes a pressing motor 72, the drive gear 73, the idler gear 74 and the drive transmission gear 75. The pressing motor 72 generates a drive force for pressing the pressure roller 132 against the fixing roller 131. The drive of the pressing motor 72 is controlled by the control unit 80 to be described later. The drive gear 73 is coupled to the pressing motor 72 and transmits a rotational drive force to the idler gear 74. The drive gear 73 is rotatably mounted on an unillustrated rotary shaft fixed to the drive shaft hole 606. The idler gear 74 transmits the rotational drive force transmitted from the drive gear 73 to the drive transmission gear 75. The idler gear 74 is rotatably mounted on the leading end part of the third shaft portion 605. The drive transmission gear 75 transmits the rotational drive force transmitted from the idler gear 74 to the gear portion 714 of the drive transmission piece 71. The drive transmission gear 75 is rotatably mounted on the second shaft portion 604.

Further, the image forming apparatus 1 includes the control unit 80 (FIGS. 2 and 3). The control unit 80 is composed of a CPU (Central Processing Unit), a ROM (Read Only Memory) storing a control program, a RAM (Random Access Memory) used as a work area of the CPU, and the like. The control unit 80 is electrically connected to the pressing motor 72, the drive motor 79 and the IH unit 133. The control unit 80 controls drive conditions of the pressing motor 72 and the drive gear 73. Further, the control unit 80 heats the fixing roller 131 by controlling the IH unit 133 (FIG. 2).

Next, a control of heating and driving the fixing device 130 is described with reference to FIGS. 5 and 6 in addition to FIGS. 3 and 4. FIG. 5 is a chart showing nip amounts of the fixing roller 131 and the pressure roller 132. In FIG. 5, NIP(0) means a state where the circumferential surfaces of the fixing roller 131 and the pressure roller 132 start contacting. Further, NIP(1), NIP(2) and NIP(3) mean nip amounts in the fixing nip portion N, i.e. a sequence of nip pressures and the nip amount increases from NIP(1) to NIP(3). Note that, in this embodiment, the nip amount in the fixing nip portion N in a state of NIP(2) is set at 1 to 1.5 mm. Further, FIG. 6 is a graph showing linear speeds (circumferential speeds) of the fixing roller 131 and the pressure roller 132 and the temperature of the fixing roller 131 when the fixing roller 131 is heated to a preset temperature.

Figure 6:
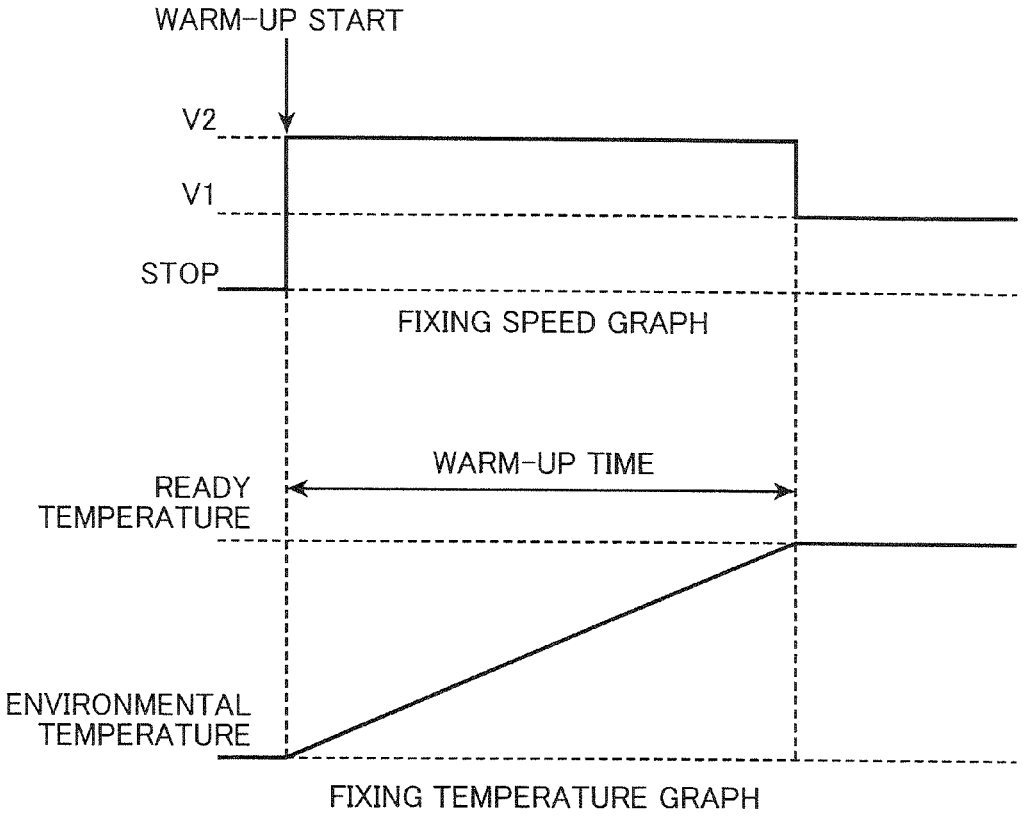
FIG. 6 is a graph showing transitions of linear speed and temperature of a fixing roller of the fixing device according to the embodiment of the present disclosure.

In FIG. 6, when the image forming apparatus 1 is powered on, the fixing device 130 starts a warm-up operation in preparation for the fixing process. In starting the warm-up operation, the control unit 80 controls the pressing portion 700 and the pressure roller 132 is pressed against the fixing roller 131.

The pressing operation of the pressure roller 132 is described in more detail. The control unit 80 drives and rotates the pressing motor 72 (FIG. 3). As a result, the rotational force of the pressing motor 72 is transmitted to the drive gear 73, the idler gear and the drive transmission gear 75. At this time, the drive transmission gear 75 is rotated clockwise in FIG. 3. When the drive transmission gear 75 is rotated, the drive input piece 712 is rotated in a direction of an arrow D31 by the engagement of the drive transmission gear 75 and the gear portion 714. Specifically, the drive transmission piece 71 is rotated about the supporting point portion 711 and the traction piece 713 is rotated in a direction of an arrow D32. According to the rotation of the traction piece 713, the load shaft 715 is pulled leftwardly to compress the biasing spring 51. When the biasing spring 51 is compressed, a reaction force is generated in the biasing spring 51 and the biasing wall 505B is biased leftwardly by the biasing spring 51. As a result, the pressing housing 50 is rotated in a direction of an arrow D4 of FIG. 4 about the third shaft portion 605. According to the rotation of the pressing housing 50, the pressure roller 132 supported on the pressure roller bearing portions 503 is pressed against the fixing roller 131. Note that the pressing operation of the pressure roller 132 against the fixing roller 131 at this time is indicated by STEP1 in FIG. 5.

When the drive transmission piece 71 is rotated and the fixing roller 131 continues to be pressed by the pressure roller 132, the restricting contact portion 506 of the pressing housing 50 eventually comes into contact with the contact surface 603A of the fixing housing 60. As a result, the inter-axis distance between the fixing roller 131 and the pressure roller 132 (distance between the fixing roller shaft 131S and the pressure roller shaft 132S) is temporarily fixed. As a result, the nip amount in the fixing nip portion N between the fixing roller 131 and the pressure roller 132 is substantially fixed at NIP(2) in a state indicated by "RESTRICTED POSITION X" of FIG. 5.

After the restricting contact portion 506 comes into contact with the contact surface 603A, the drive transmission piece 71 is rotated while the biasing spring 51 continues to be compressed. When the detection piece 716 (FIG. 3) of the drive transmission piece 71 is detected by the unillustrated sensor, the rotation of the drive transmission piece 71 by the pressing motor 72 is stopped. The control unit 80 controls the IH unit 133 (FIG. 2) to start the warm-up operation of the fixing roller 131 after the pressing operation of the pressure roller 132 is finished. The fixing roller 131 is gradually heated from an environmental temperature represented by an ordinary temperature. Simultaneously, the control unit 80 controls the drive motor 79 to drive and rotate the pressure roller 132. As a result, the fixing roller 131 is rotated by the rotation of the pressure roller 132. Note that, in this embodiment, the control unit 80 drives and rotates the pressure roller 132 at a rotation speed V2 faster than a rotation speed V1 of the pressure roller 132 during a normal fixing process in the warm-up operation (FIG. 6).

With reference to FIGS. 5 and 6, when the warm-up operation is performed, the temperature of the fixing roller 131 is increased and the elastic layer 131B of the fixing roller 131 thermally expands. As a result, the pressure roller 132 is slightly pushed back in a direction away from the fixing roller 131 by the thermal expansion of the elastic layer 131B (STEP2 of FIG. 5). At this time, the restricting contact portion 506 held in contact with the contact surface 603A is separated from the contact surface 603A.

When it is detected by an unillustrated temperature sensor that the fixing roller 131 has been heated to a preset temperature Ready, the warm-up operation of the fixing roller 131 is completed. As a result, a thermal expansion force of the elastic layer 131B of the fixing roller 131 and a biasing force of the biasing spring 51 (FIG. 3) are balanced and the nip amount in the fixing nip portion N is set at NIP(1) of FIG. 5. The fixing roller 131 and the pressure roller 132 can perform a sheet fixing process at a preset fixing temperature and the nip amount NIP(1) in the fixing nip portion N. At this time, the control unit 80 controls the drive motor 79 to reduce the rotation speed of the pressure roller 132 (fixing roller 131) to the normal rotation speed V1 (FIG. 6).

As just described, in the warm-up operation of the fixing device 130 in this embodiment, the pressing portion 700 causes the pressure roller 132 to be pressed against the fixing roller 131 while compressing the elastic layer 131B arranged on the circumferential surface of the fixing roller 131 before the heating of the fixing roller 131 by the IH unit 133 is started. At this time, the restricting portion 5 configured by the restricting contact portion 506 and the contact surface 603A restricts the inter-axis distance between the fixing roller 131 and the pressure roller 132 to be equal to or longer than the predetermined distance in the compression process of the elastic layer 131B. As a result, the compression amount of the elastic layer 131B is restricted so as not to exceed the preset compression amount (NIP(2)). The drive motor 79 drives and rotates the pressure roller 132 with the inter-axis distance restricted by the restricting portion 5. Thus, the drive motor 79 can drive and rotate the pressure roller 132 without the elastic layer 131B being excessively compressed. As a result, an increase in a drive torque of the drive motor 79 is suppressed.

Particularly with reference to FIG. 5, if the pressure roller 132 continues to be pressed against the fixing roller 131 by the biasing force of the biasing spring 51 when the restricting portion 5 is not arranged, the nip amount in the fixing nip portion N reaches NIP(3) (STEP1A of FIG. 5). This is because the apparent hardness of the elastic layer 131B is low and the elastic layer 131B is easily deformed (compressed) before the warm-up operation is started. In this case, a rotation load between the fixing roller 131 and the pressure roller 132 is increased by the nip amount NIP(3) larger than the normally used nip amounts NIP(1) and NIP(2). Thus, if the pressure roller 132 is driven and rotated and the warm-up operation is started in a state of NIP(3), the drive torque of the drive motor 79 for driving and rotating the pressure roller 132 is drastically increased. If the warm-up operation progresses and the elastic layer 131B thermally expands in a state of increased drive torque, the nip amount in the fixing nip portion N changes to NIP(1) (STEP2A of FIG. 5). As a result, a large load acts on the drive motor 79.

Further, according to the above embodiment, the pressing portion 700 presses the pressure roller 132 against the fixing roller 131 by biasing the pressing housing 50 toward the fixing housing 60. Thus, the fixing nip portion N between the fixing roller 131 and the pressure roller 132 can be stably formed.

Further, the inter-axis distance between the fixing roller 131 and the pressure roller 132 is maintained at the predetermined distance by the contact of the restricting contact portion 506 with the contact surface 603A in the compression process of the elastic layer 131B by the pressing portion 700. Thus, excessive compression of the elastic layer 131B is preferably suppressed.

Further, when the fixing roller 131 is heated and the elastic layer 131B thermally expands, the restricting contact portion 506 is separated from the contact surface 603A. Thus, a contact load between the fixing roller 131 and the pressure roller 132 is stably maintained while a thermal expansion force of the elastic layer 131B and a pressing force of the pressing portion 700 are balanced.

Further, the drive motor 79 drives and rotates the pressure roller 132 at the rotation speed V2 faster than at the time of sheet passage until the fixing roller 131 is heated to the predetermined temperature. Thus, a temperature increasing time of the fixing roller 131 can be shortened in a state where the drive torque of the drive motor 79 is reduced.

Further, the fixing housing 60 includes the pair of housing side wall portions 601 with the fixing roller bearing portion 602 for rotatably supporting the fixing roller 131 and the third shaft portion 605 projecting from the housing-side wall portion 601 in the axial direction of the fixing roller 131. Further, the pressing housing 50 includes the pair of pressing-side wall portions 502 with the pressure roller bearing portion 503 for rotatably supporting the pressure roller 132, and the engaging hole 504 arranged on the pressing-side wall portion 502 and engaged with the third shaft portion 605. The pressing portion 700 presses the pressure roller 132 against the fixing roller 131 by rotating the pressing housing 50 about the third shaft portions 605. Thus, the fixing nip portion N is stably formed by the rotation of the pressing housing 50.

Further, the pressure roller 132 is pressed against the fixing roller 131 by the drive transmission piece 71, the biasing portion 505 and the biasing spring 51. When the pressure roller 132 is pressed against the fixing roller 131 according to the rotation of the pressing housing 50, the elastic layer 131B of the fixing roller 131 is compressed. The restricting contact portion 506 of the press-side wall portion 502 comes into contact with the contact surface 603A of the first shaft portion 603 projecting from the housing-side wall portion 601 in the compression process of the elastic layer 131B. Thus, the compression amount of the elastic layer 131B is preferably restricted by the rotation of the pressing housing 50 relative to the fixing housing 60.

Further, the pressure roller 132 is preferably pressed against the fixing roller 131 by the drive transmission from the pressing/driving unit 701 to the gear portion 714. Although the fixing device 130 and the image forming apparatus 1 according to the embodiment of the present disclosure have been described above, the present disclosure is not limited to this and can be, for example, modified as follows.

(1) Although the elastic layer 131B is arranged on the fixing roller 131 in the above embodiment, the present disclosure is not limited to this. The elastic layer 131B may be arranged on the fixing roller 131 and the pressure roller 132 or only on the pressure roller 132. Further, the fixing nip portion N may be formed by pressing the fixing roller 131 against the pressure roller 132. Furthermore, the drive motor 79 is not limited to a mode of driving and rotating the pressure roller 132 and may drive and rotate the fixing roller 131.

(2) Further, although the restricting portion 5 is composed of the restricting contact portion 506 and the contact surface 603A in the above embodiment, the present disclosure is not limited to this. Any mode may be adopted if the restricting portion 5 is configured to restrict the inter-axis distance between the fixing roller 131 and the pressure roller 132 so that the inter-axis distance becomes equal to or longer than the preset distance in the compression process of the elastic layer 131B. The pressing-side wall portions 502 of the pressing housing 50 and the housing-side wall portions 601 of the fixing housing 60 may be directly brought into contact.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A fixing device comprising:

a heat source;

a fixing roller that is heated by the heat source;

a first housing that rotatably supports the fixing roller;

a pressure roller that is held in contact with the fixing roller so that a fixing nip portion is formed between the pressure roller and the fixing roller and through which a sheet is to be passed;

a second housing that rotatably supports the pressure roller;

an elastic layer formed on a circumferential surface or an inner layer of the fixing roller or the pressure roller;

a pressing portion that presses one roller of the fixing roller and the pressure roller against the other roller by biasing one of the first and second housings toward the other while compressing the elastic layer;

a restricting portion that restricts a compression amount of the elastic layer lest the compression amount should exceed a preset compression amount when the pressing portion presses the roller, the restricting portion restricting the compression amount of the elastic layer by restricting an inter-axis distance between the fixing roller and the pressure roller lest the inter-axis distance should become equal to or shorter than a preset distance, the restricting portion including a contact portion arranged on one of the first and second housings and a contacted portion arranged on the other of the first and second housings different from the one on which the contact portion is arranged, the inter-axis distance being restricted by contact of the contact portion with the contacted portion, the contact portion is separated from the contacted portion by thermal expansion of the elastic layer when the fixing roller is heated to a preset temperature by the heat source; and a driving unit that drives and rotates one of the fixing roller and the pressure roller in a state where the compression amount is restricted by the restricting portion.

2. A fixing device according to claim 1, wherein:

the driving unit drives and rotates the roller at a first rotation speed when the sheet is passed through the fixing nip portion after the fixing roller is heated to a preset temperature and drives and rotates the roller at a second rotation speed faster than the first rotation speed until the fixing roller is heated to the set temperature.

3. A fixing device comprising:

a heat source;

a fixing roller that is heated by the heat source;

a first housing that rotatably supports the fixing roller, the first housing includes:

a pair of first side wall portions that include a first bearing portion for rotatably supporting the fixing roller, and a first rotary shaft that projects in an axial direction of the fixing roller from the first side wall portion;

a pressure roller that is held in contact with the fixing roller so that a fixing nip portion is formed between the pressure roller and the fixing roller and through which a sheet is to be passed;

a second housing that rotatably supports the pressure roller, the second housing includes:

a pair of second side wall portions that include a second bearing portion for rotatably supporting the pressure roller, and an engaging portion that is arranged on the second side wall portion and engaged with the first rotary shaft;

an elastic layer formed on a circumferential surface or an inner layer of the fixing roller or the pressure roller;

a pressing that portion presses the pressure roller against the fixing roller by rotating the second housing about the first rotary shaft and biasing one of the first and second housings toward the other while pressing the elastic layer;

a restricting portion that restricts a compression amount of the elastic layer lest the compression amount should exceed a preset compression amount when the pressing portion presses the pressure roller, the restricting portion restricting the compression amount of the elastic layer by restricting an inter-axis distance between the fixing roller and the pressure roller lest the inter-axis distance should become equal to or shorter than a preset distance; and a driving unit that drives and rotates one of the fixing roller and the pressure roller in a state where the compression amount is restricted by the restricting portion.

4. A fixing device according to claim 3, wherein:

the restricting portion includes a contact portion arranged on one of the first and second housings and a contacted portion arranged on the other of the first and second housings different from the one on which the contact portion is arranged; and the inter-axis distance is restricted by the contact of the contact portion with the contacted portion.

5. A fixing device according to claim 3, wherein:

the pressing portion includes:

a biasing portion which is arranged at a side of the second bearing portion opposite to the engaging portion on the second side wall portion of the second housing and includes an opening facing the first housing;

a second rotary shaft which projects in the axial direction from the first side wall portion of the first housing;

a rotation piece which is rotatably coupled to the second rotary shaft and includes a first rotating portion extending in one direction from the second rotary shaft;

a shaft portion which extends from the first rotating portion through the opening and includes a flange portion on an end part of the second housing side; and a biasing spring which is externally fitted on the shaft portion and compressively arranged between the biasing portion and the flange portion; and the rotation piece is rotated about the second rotary shaft and the flange portion compresses the biasing spring, whereby the biasing spring biases the biasing portion and the second housing is rotated about the first rotary shaft.

6. A fixing device according to claim 5, wherein:

the contact portion is arranged on the second side wall portion and the contacted portion is arranged on the second rotary shaft.

7. A fixing device according to claim 5, wherein:

the pressing portion includes:

a second rotating portion which is a part of the rotation piece extending toward a side opposite to the first rotating portion;

a gear portion which is arranged on a leading end part of the second rotating portion; and a pressing/driving unit which transmits a drive force to the gear portion and rotates the rotation piece about the second rotary shaft.

8. An image forming apparatus, comprising:

an image forming unit for forming an image on a sheet; and a fixing device for applying a fixing process to the sheet, wherein:

the fixing device includes:

a heat source;

a fixing roller that is heated by the heat source;

a first housing that rotatably supports the fixing roller;

a pressure roller that is held in contact with the fixing roller and forms a fixing nip portion between the pressure roller and the fixing roller and through which a sheet is to be passed;

a second housing that rotatably supports the pressure roller;

an elastic layer that is formed on a circumferential surface or an inner layer of the fixing roller or the pressure roller;

a pressing portion that presses one roller of the fixing roller and the pressure roller against the other roller by biasing one of the first and second housings toward the other while compressing the elastic layer;

a restricting portion that restricts a compression amount of the elastic layer lest the compression amount should exceed a preset compression amount when the pressing portion presses the roller, the restricting portion restricting the compression amount of the elastic layer by restricting an inter-axis distance between the fixing roller and the pressure roller lest the inter-axis distance should become equal to or shorter than a preset distance, the restricting portion including a contact portion arranged on one of the first and second housings and a contacted portion arranged on the other of the first and second housings different from the one on which the contact portion is arranged, the inter-axis distance being restricted by contact of the contact portion with the contacted portion, the contact portion is separated from the contacted portion by thermal expansion of the elastic layer when the fixing roller is heated to a preset temperature by the heat source; and a driving unit that drives and rotates one of the fixing roller and the pressure roller in a state where the compression amount is restricted by the restricting portion.

9. An image forming apparatus according to claim 8, wherein:

the driving unit drives and rotates the roller at a first rotation speed when the sheet is passed through the fixing nip portion after the fixing roller is heated to a preset temperature and drives and rotates the roller at a second rotation speed faster than the first rotation speed until the fixing roller is heated to the set temperature.

10. An image forming apparatus according to claim 8, wherein:

the first housing includes:

a pair of first side wall portions which include a first bearing portion for rotatably supporting the fixing roller, and a first rotary shaft which projects in an axial direction of the fixing roller from the first side wall portion;

the second housing includes:

a pair of second side wall portions which include a second bearing portion for rotatably supporting the pressure roller, and an engaging portion which is arranged on the second side wall portion and engaged with the first rotary shaft; and the pressing portion presses the pressure roller against the fixing roller by rotating the second housing about the first rotary shaft.

11. An image forming apparatus according to claim 10, wherein:

the pressing portion includes:

a biasing portion which is arranged at a side of the second bearing portion opposite to the engaging portion on the second side wall portion of the second housing and includes an opening facing the first housing;

a second rotary shaft which projects in the axial direction from the first side wall portion of the first housing;

a rotation piece which is rotatably coupled to the second rotary shaft and includes a first rotating portion extending in one direction from the second rotary shaft;

a shaft portion which extends from the first rotating portion through the opening and includes a flange portion on an end part of the second housing side; and a biasing spring which is externally fitted on the shaft portion and compressively arranged between the biasing portion and the flange portion; and the rotation piece is rotated about the second rotary shaft and the flange portion compresses the biasing spring, whereby the biasing spring biases the biasing portion and the second housing is rotated about the first rotary shaft.

12. An image forming apparatus according to claim 11, wherein:

the contact portion is arranged on the second side wall portion and the contacted portion is arranged on the second rotary shaft.

13. An image forming apparatus according to claim 11, wherein:

the pressing portion includes:

a second rotating portion which is a part of the rotation piece extending toward a side opposite to the first rotating portion;

a gear portion which is arranged on a leading end part of the second rotating portion; and a pressing/driving unit which transmits a drive force to the gear portion and rotates the rotation piece about the second rotary shaft.

* * * * *